United States Patent [19]

Tamba et al.

[11] Patent Number: 4,934,342

[45] Date of Patent: Jun. 19, 1990

[54] INTAKE MANIFOLD FOR INTERNAL COMBUSTION VEE-ENGINE AND MANUFACTURING METHOD OF INTAKE MANIFOLD

[75] Inventors: Shinichi Tamba, Kakogawa; Hitomi Miyake, Miki, both of Japan

[73] Assignee: Kawasaki Jukogyo Kabushiki Kaisha, Japan

[21] Appl. No.: 132,183

[22] Filed: Dec. 14, 1987

[30] Foreign Application Priority Data

Dec. 16, 1986 [JP] Japan ..... 61-300392

[51] Int. Cl.[5] ..... F02M 13/04

[52] U.S. Cl. ..... 123/52 MV

[58] Field of Search ..... 123/52 MV, 52 M, 52 ML, 123/432

[56] References Cited

U.S. PATENT DOCUMENTS

| | | | |
|---|---|---|---|
| 1,396,904 | 11/1921 | White | 123/52 MV |
| 1,467,970 | 9/1923 | Woolson | 123/52 MC |
| 1,938,252 | 12/1933 | Hamacheck | 123/52 M |
| 1,998,636 | 4/1935 | Porter | 123/52 MV |
| 2,152,594 | 3/1939 | Klotsch | 123/52 MV |
| 2,306,580 | 12/1942 | Wilson | 123/52 MV |
| 2,759,463 | 8/1956 | Platner | 123/52 MV |
| 2,845,912 | 8/1958 | Bird | 123/52 MV |
| 2,957,464 | 10/1960 | Dolza | 123/52 MV |
| 4,210,107 | 7/1980 | Shaffer | 123/52 MV |
| 4,318,380 | 3/1982 | Matsumoto | 123/52 M |
| 4,359,024 | 11/1982 | Lootens et al. | 123/52 M |
| 4,516,538 | 5/1985 | Arakawa et al. | 123/52 M |
| 4,658,767 | 4/1987 | Fujikawa et al. | 123/52 MV |
| 4,697,557 | 10/1987 | Tamba et al. | 123/319 |
| 4,738,227 | 4/1988 | Wada et al. | 123/52 MV |

FOREIGN PATENT DOCUMENTS

| | | | |
|---|---|---|---|
| 57-119155 | 7/1982 | Japan . | |
| 2205607 | 12/1988 | United Kingdom | 123/52 M |

*Primary Examiner*—David A. Okonsky

*Attorney, Agent, or Firm*—Leydig, Voit & Mayer

[57] ABSTRACT

An intake manifold is provided which communicates with left and right intake passages located respectively in left and right cylinder banks of an internal combustion vee-engine. The intake manifold comprises a single inlet passage portion, and two branch passage portions which branch from an outlet end of the inlet passage portion and which communicate respectively with the intake passages. Each of these passage portions is formed straight so that the intake manifold can be cast by means of metal dies. Also disclosed in a method of manufacturing the intake manifold.

9 Claims, 4 Drawing Sheets

INTAKE MANIFOLD FOR INTERNAL COMBUSTION VEE-ENGINE AND MANUFACTURING METHOD OF INTAKE MANIFOLD

BACKGROUND OF THE INVENTION

The present invention relates to an intake manifold for internal combustion vee-engines, and to a method of manufacturing the intake manifold.

In an arrangement of the conventional intake manifold for internal combustion vee-engines, two branch passage portions branch from one end of an intake pipe portion or an inlet passage portion connected to a substantially central section of the intake manifold, as disclosed, for example, in Japanese Patent Application Laid-Open no. 57-119155. The two branch passage portions extend in a curved fashion in their respective directions opposite to each other, and communicate respectively with intake passages provided respectively in left and right cylinder banks.

However, the above-described conventional arrangement has various problems. That is, because both branch passage portions are formed in a curved fashion, the intake manifold becomes complicated in structure. Not only does this result in an increase in the cost, but also makes it impossible to cast the intake manifold by means of metal dies. If the intake manifold is cast by means of molds other than the metal dies, it is necessary to employ cores, resulting in an increase in the cost. Variation is large in the contour of the cast products, in particular, in the contour of the passages for the intake mixture, so that the engine performance is rather scattered. Considerably extensive machining is required for the cast intake manifold. Moreover, if a water channel for cooling water after having cooled the engine is desired to be formed in parallel with the branch passage portions to preheat intake mixture flowing therethrough, the intake manifold is further complicated in structure, making it difficult to cast the intake manifold.

SUMMARY OF THE INVENTION

It is an object of the present invention to provide an intake manifold for internal combustion vee-engines, which lacks the above-discussed problems of the conventional arrangement, and which can be cast by means of dies at low cost.

It is another object of the invention to provide a method of manufacturing the intake manifold.

According to the present invention, there is provided an intake manifold in communication with intake passages provided respectively in left and right cylinder banks of an internal combustion vee-engine, in which an intake pipe portion or an inlet passage portion provided at a substantially central section of the intake manifold is formed straight, and each of two branch passage portions is also formed straight, which two branch passage portions branch from an outlet end of the inlet passage portion in their respective directions opposite to each other and communicate respectively with the intake passages provided respectively in the left and right cylinder banks.

According to the invention, there is also provided a method of manufacturing an intake manifold, in which a female die is prepared which has defined therein a first cavity bore for molding an inlet passage portion provided at a substantially central section of the intake manifold, and second and third cavity bores for molding respectively two branch passage portions which branch from an outlet end of the inlet passage portion in their respective directions opposite to each other and which communicate respectively with intake passages provided respectively in left and right cylinder banks; first, second and third pin-like straight male dies are prepared and are inserted respectively into the first, second and third cavity bores until forward ends of the respective first, second and third pin-like male dies abut against each other at a location where the two branch passage portions branch from the outlet end of the inlet passage portion, to define a mold cavity between the female and male dies; and the mold cavity is filled with molten metal.

In the above-described manufacturing method according to the invention, the first, second and third pin-like male dies are withdrawn straight from a solidified product to obtain the intake manifold according to the invention.

DETAILED DESCRIPTION

The invention will be described in detail with reference to embodiments illustrated in FIGS. 1 through 6.

Figure 1:
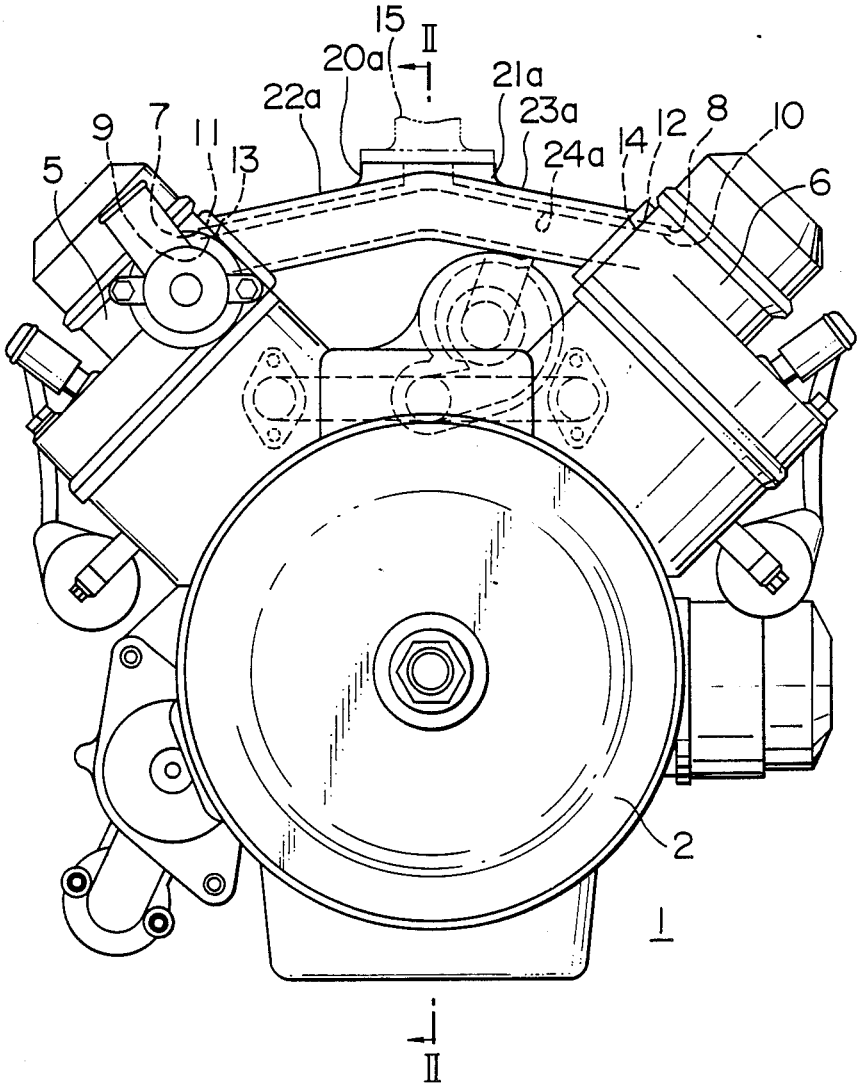
FIG. 1 is a front elevational view of an internal combustion vee-engine having incorporated therein an intake manifold according to an embodiment of the invention.
Figure 2:
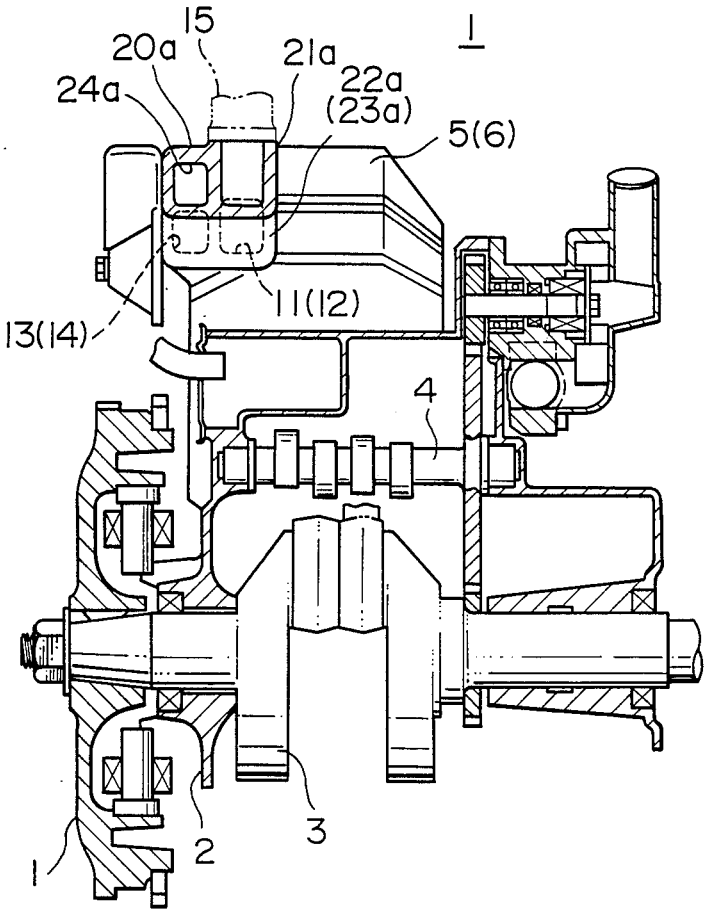
FIG. 2 is a cross-sectional view taken along line II—II in FIG. 1.
Figure 3:
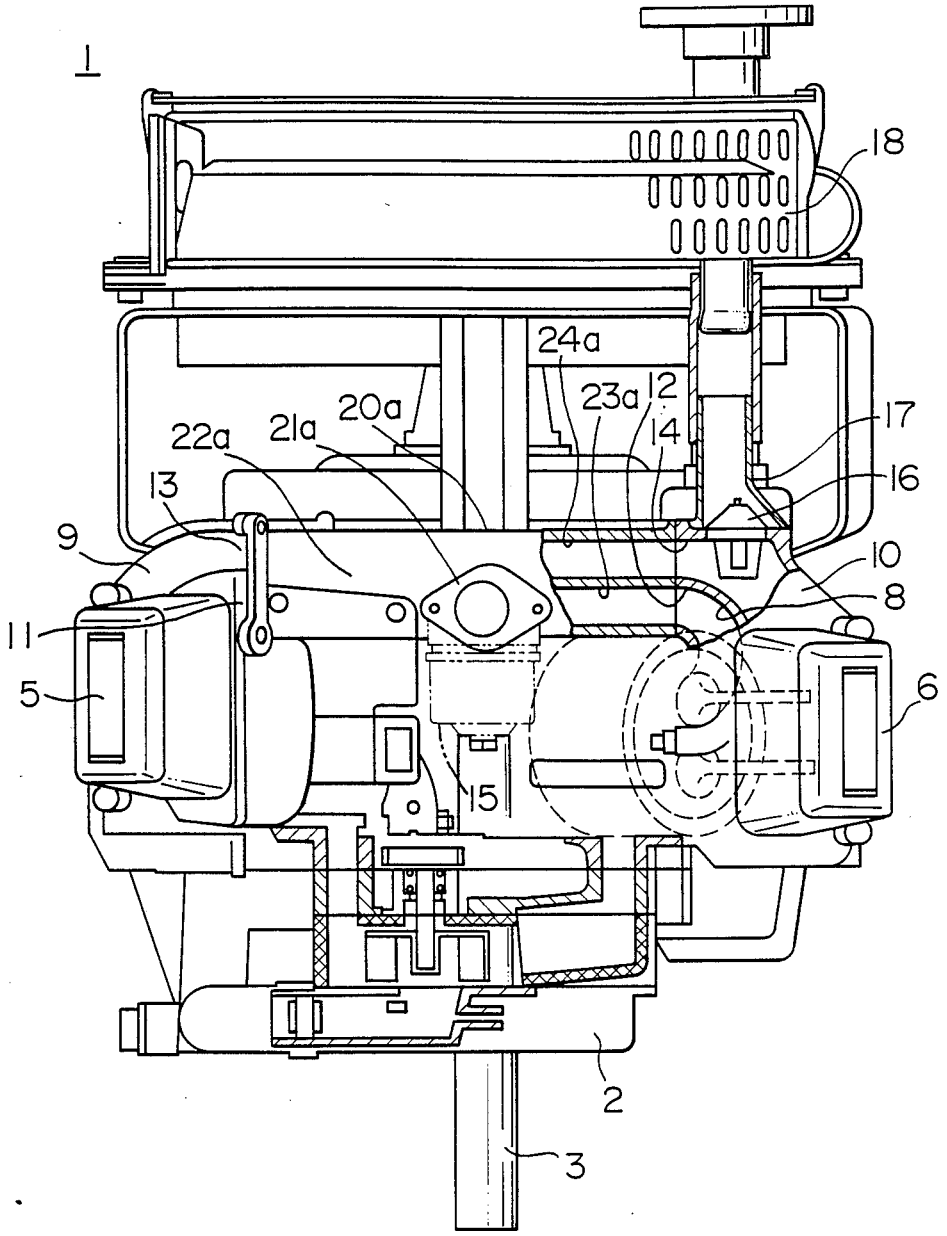
FIG. 3 is a top plan view of the engine illustrated in FIG. 1.

Referring first to FIGS. 1 through 3, there is illustrated an internal combustion two-cylinder vee-engine 1 which comprises a crank case 2, and a crankshaft 3 and a cam shaft 4 arranged within the crank case 2. Left and right cylinder blocks 5 and 6 are arranged in V-shape on the outside of the crank case 2. The cylinder blocks 5 and 6 have formed therein their respective intake passages 7 and 8 and respective water jackets 9 and 10. The intake passages 7 and 8 have their respective inlets 11 and 12 which open respectively to the exterior surfaces of the respective cylinder blocks 5 and 6. The water jackets 9 and 10 have their respective outlets 13 and 14 which are located respectively adjacent the inlets 11 and 12 and which open respectively to the exterior surfaces of the respective cylinder blocks 5 and 6. The inlets 11 and 12 are arranged in a plane perpendicular to the crankshaft 3. The outlets 13 and 14 are also arranged in a plane perpendicular to the crankshaft 3. An intake manifold 20*a* according to an embodiment of the invention comprises an intake pipe portion or an inlet passage portion 21*a* provided at a substantially central section of the intake manifold 20*a*. The intake manifold 20*a* further has two branch passage portions 22*a* and 23*a* which branch in an inverted Y-shape from an outlet end of the inlet passage portion 21*a* and which communicate respectively with the inlets 11 and 12 of the intake passages 7 and 8 in the respective cylinder blocks 5 and 6. Each of the inlet passage portion 21*a* and the branch passage portions 22*a* and 23*a* are formed straight. The branch passage portions 22*a* and 23*a* are formed with a water channel 24*a* which extends in parallel with the branch passage portions 22*a* and 23*a* and which communicates the outlets 13 and 14 of the water jackets 9 and 10 in the respective cylinder blocks 5 and 6 with each other.

A carburetor 15 is adapted to be connected to an inlet end of the inlet passage portion 21*a* of the intake manifold 20*a* constructed as described above. Intake mixture is supplied from the carburetor 15 into the inlet passage portion 21*a*. The intake mixture is divided into two streams flowing respectively through the branch passage portions 22*a* and 23*a*. The intake mixture is supplied into the intake passages 7 and 8 through their respective inlets 11 and 12. On the other hand, cooling water flowing from the water jacket 9 through the outlet 13, and cooling water flowing from the water jacket 10 through the outlet 14 join within the water channel 24*a* to heat the intake mixture within the branch passage portions 22*a* and 23*a*. Subsequently, the cooling water is delivered to a radiator 18 through a cooling water pipe 17. Because of heating of the intake mixture, evaporation of fuel in the intake mixture is promoted thereby making it possible to improve combustion of the fuel within the cylinder blocks 5 and 6 and facilitating the starting of the engine 1 at cold weather. The arrangement of the intake manifold 20*a* is such that each of the inlet passage portion 21*a* and the branch passage portions 22*a* and 23*a* is formed straight, and the water channel 24*a* is formed in parallel with the branch passage portions 22*a* and 23*a*. Such arrangement simplifies the structure of the intake manifold 20*a*, resulting in a reduction of the cost, and enables the intake manifold 20*a* to be cast by means of metal dies. Further, since the inlets 11 and 12 are arranged in a plane perpendicular to the crankshaft 3 and the outlets 13 and 14 are also arranged in a plane perpendicular to the crankshaft 3, the intake manifold 20*a* can be cast together with the water channel 24*a* by the dies in a horizontal position.

Figure 4:
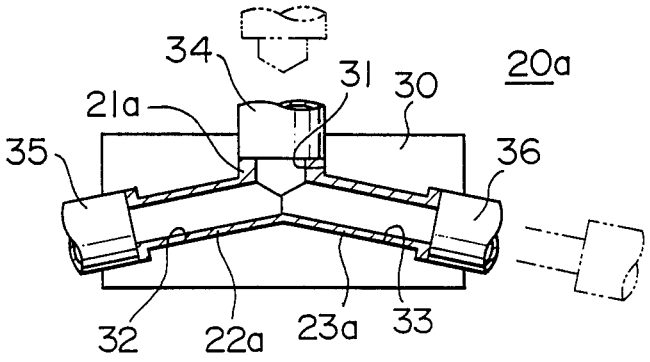
FIG. 4 is a front elevational view of dies for use in casting the intake manifold shown in FIG. 1 for illustration of a manufacturing method according to the invention, with one of a pair of die halves of a female die removed.

Casting (die casting, for example) of the intake manifold 20*a* constructed as described above, by means of dies will be described with reference to FIG. 4. A single female die 30 is first prepared which is composed by a pair of die halves. The female die 30 has defined therein a first cavity bore 31 for molding the inlet passage portion 21*a*, and second and third cavity bores 32 and 33 for respectively molding the branch passage portions 22*a* and 23*a*. First, second and third pin-like male dies 34, 35 and 36 are prepared which have their respective straight core portions. The three male dies 34, 35 and 36 are inserted respectively into the first, second and third cavity bores 31, 32 and 33 until forward ends of the core portions of the respective first, second and third male dies 34, 35 and 36 abut against each other at a location where the branch passage portions 22*a* and 23*a* branch from the inlet passage portion 21*a*, to define a mold cavity between the female and male dies. Subsequently, molten metal is poured into the mold cavity to fill the same. The molten metal is cooled and solidified. After the solidification, the first, second and third male dies 34, 35 and 36 are withdrawn straight respectively from the straight cast inlet passage portion 21*a* and the straight cast branch passage portions 22*a* and 23*a*. After or before withdrawing of the male dies 34, 35 and 36, the female die 30 is disassembled to obtain a product of the intake manifold 20*a*. Although the water channel 24*a* is omitted from FIG. 4, the water channel 24*a* can be cast in a manner like that described above with reference to the casting of the branch passage portions 22*a* and 23*a*.

Figure 5:
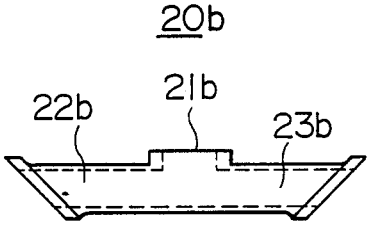
FIG. 5 is a front elevational view of the intake manifold according to another embodiment of the invention.

FIG. 5 shows an intake manifold 20*b* according to another embodiment. The intake manifold 20*b* comprises an inlet passage portion 21*b* and left and right branch passage portions 22*b* and 23*b* and is similar in structure with the intake manifold 20*a* except that the branch passage portions 22*b* and 23*b* extend in coaxial relation to each other in a straight line. The inlet passage portion 21*b* is formed perpendicularly to the straight line. The intake manifold 20*b* can be cast in a manner similar to that described above with reference to the intake manifold 20*a*. The intake manifold 20*b* is advantageous, as compared with the case of the intake manifold 20*a*, in that the intake manifold 20*b* is shortened in length or reduced in overall dimension, the dies are simplified in structure, it is possible to restrain outward projection or extension of the carburetor 15 and the like, and it is easy to remove internal casting fins or flashes.

Figure 6:
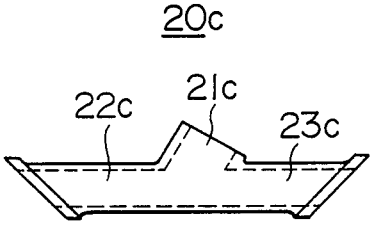
FIG. 6 is a view similar to FIG. 5, but showing still another embodiment of the invention.

FIG. 6 shows an intake manifold 20*c* according to still another embodiment. The intake manifold 20*c* comprises an inlet passage portion 21*c* and left and right branch passage portions 22*c* and 23*c* and is similar in structure to the intake manifold 20*b* shown in FIG. 5, except that the inlet passage portion 21*c* is inclined with respect to the common axis of the branch passage portions 22*c* and 23*c*. Accordingly, the intake manifold 20*c* is similar in functional advantage and manufacturing method to the intake manifold 20*b*.

The invention has been described as having the inlet passage portion and the branch passage portions which have their respective axes located in a single common plane. However, the invention should not be limited to this specific form. Any one or two of these axes may be inclined with respect to the plane. Further, the water channel may be separate from the intake manifold, and may, of course, be dispensed with if the engine is of an air-cooled type.

The intake manifold constructed as described above according to the invention has the following advantages.

Because each of the inlet passage portion and the branch passage portions is formed straight, the intake manifold is simplified in structure, whereby the cost is reduced and it is made possible to cast the intake manifold by means of metal dies.

If the intake manifold is cast by means of the metal dies, the cost is reduced considerably, dispersion in contour of products is reduced to stabilize the engine performance, it is possible to reduce the wall thickness of the intake manifold to lighten the same, and machining after casting is eased.

If the left and right branch passage portions are made straight and arranged in one plane, the intake manifold can be shortened in length or reduced in overall dimension, the dies can be simplified in structure, it is possible to restrain outward projection or extension of the carburetor and the like, and it is easy to remove internal casting fins or flashes.

If the water channel communicating the water jackets for the respective left and right cylinder banks with each other is provided in parallel with the branch passage portions, intake mixture is heated by the cooling water passing through the water channel, thereby promoting evaporation of fuel in the intake mixture so that combustion within the cylinders is improved and the starting of the engine at cold weather is made easy.

What is claimed is:

1. An intake manifold adapted to communicate with left and right intake passages provided respectively in left and right cylinder banks of an internal combustion vee-engine, said intake manifold comprising a single inlet passage portion having an outlet end, and two branch passage portions branching from said outlet end of said inlet passage portion and adapted to communicate respectively with said intake passages, each of said inlet passage portion and said branch passage portions being formed entirely straight, said intake manifold having an inverted Y-shape.

2. An intake manifold as defined in claim 1 including a water channel extending adjacent and parallel to said branch passage portions, said water channel having its opposite ends adapted to communicate respectively with water jackets of the respective left and right cylinder banks.

3. An intake manifold as defined in claim 1 wherein the intake manifold is symmetrical with reference to a plane passing through the axis of said inlet passage portion.

4. An intake manifold as defined in claim 3, including a water channel extending adjacent and parallel to said branch passage portions, said water channel having its opposite ends adapted to communicate respectively with water jackets of the respective left and right cylinder banks.

5. An intake manifold adapted to communicate with left and right intake passages provided respectively in left and right cylinder banks of an internal combustion vee-engine, said intake manifold comprising a single inlet passage portion having an outlet end and two branch passage portions arranged coaxially and branching from said outlet end of said inlet passage, said branch passage portions adapted to communicate respectively with said intake passages, each of said inlet passage portion and said branch passage portions being formed straight and the axis of said inlet passage portion forming an acute angle with the axis of one of said branch passage portions.

6. An intake manifold as defined in claim 5, wherein said two branch passage portions are aligned with each other on a straight line.

7. An intake manifold as defined in claim 6, including a water channel extending adjacent and parallel to said branch passage portions, said water channel having its opposite ends adapted to communicate respectively with water jackets of the respective left and right cylinder banks.

8. An intake manifold as defined in claim 6, wherein the intake manifold is symmetrical with reference to a plane passing through the axis of said inlet passage portion.

9. An intake manifold as defined in claim 5, including a water channel extending adjacent and parallel to said branch passage portions, said water channel having its opposite ends adapted to communicate with water jackets of the respective left and right cylinder banks.

* * * * *